US007407455B2

(12) United States Patent
Tucker, Jr.

(10) Patent No.: US 7,407,455 B2
(45) Date of Patent: Aug. 5, 2008

(54) LACROSSE HEAD HAVING A WIDE CATCHING AREA AND CHANNELED THONGS

(75) Inventor: Richard B. C. Tucker, Jr., Baltimore, MD (US)

(73) Assignee: STX, LLC, Baltimore, MD (US)

( * ) Notice: Subject to any disclaimer, the term of this patent is extended or adjusted under 35 U.S.C. 154(b) by 241 days.

(21) Appl. No.: 11/185,700

(22) Filed: Jul. 21, 2005

(65) Prior Publication Data

US 2006/0019778 A1 Jan. 26, 2006

Related U.S. Application Data

(60) Provisional application No. 60/590,333, filed on Jul. 23, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512–514, 528, 543; D21/724
See application file for complete search history.

(56) References Cited

U.S. PATENT DOCUMENTS 3,507,495 A 4/1970 Tucker et al.
4,034,984 A 7/1977 Crawford et al.
5,566,947 A 10/1996 Tucker et al.
5,685,791 A * 11/1997 Feeney ..... 473/513
RE37,894 E * 10/2002 MacNeil ..... 473/513
6,929,572 B2 * 8/2005 Morrow et al. ..... 473/513

* cited by examiner

*Primary Examiner*—Gene Kim
*Assistant Examiner*—M Chambers
(74) *Attorney, Agent, or Firm*—Paul, Hastings, Janofsky & Walker LLP

(57) ABSTRACT

A lacrosse head having a wide catching area and channeled thongs. One embodiment includes a stop member, a left sidewall connected to the stop member, a right sidewall connected to the stop member, and a scoop connecting the left sidewall to the right sidewall opposite the stop member. The scoop is disposed about 25.5 cm from the stop member. The widest point of lacrosse head is in a catching section disposed from about 6 cm to about 17 cm from the stop member. The left sidewall is convex with respect to the interior area of the head at a portion of the left sidewall between the widest point and the scoop. The right sidewall is convex at a portion of the right sidewall between the widest point and the scoop. In another embodiment, the sidewalls rise from the plane of the scoop and include thong holes to provide channeled thongs.

27 Claims, 8 Drawing Sheets

LACROSSE HEAD HAVING A WIDE CATCHING AREA AND CHANNELED THONGS

This application claims the benefit of U.S. Provisional Application No. 60/590,333, filed Jul. 23, 2004, which is herein incorporated by reference in its entirety.

BACKGROUND

1. Field of the Invention

The present invention relates generally to lacrosse sticks, and more particularly, to a lacrosse stick head having a wide catching area and channeled thongs.

2. Background of the Invention

In 1970, the introduction of double-wall, synthetic lacrosse heads revolutionized the game of lacrosse. In comparison to the traditional wooden single-wall heads, the synthetic heads imparted a balance, lightness, maneuverability, and flexibility never-before experienced by lacrosse players. These performance advantages greatly enhanced players' skills such as throwing, catching, cradling, and scooping, and brought the sport of lacrosse to new levels of speed and excitement.

FIG. 1A illustrates a conventional lacrosse stick 100 having a handle 102 shown in dotted lines and a double-wall synthetic head 104. Head 104 includes a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in scoop 112 to lower thong holes 118 in stop member 114. In some designs, such as the design shown in FIG. 1A, upper thong holes 116 are located on tabs 117 of the scoop 112. In other designs, upper thong holes 116 are located directly on the scoop 112. FIG. 1A shows four pairs (116, 118) of thong holes that accept four thongs.

To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string hole 124 and a string laced through string hole 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In addition to traditionally strung heads, some heads use mesh pockets or a combination of traditional and mesh stringing. In any case, the mesh or stringing is conventionally attached to the head through holes in the scoop, sidewalls, and stop members, or by tabs attached to the scoop, sidewalls, and stop members. These tabs can have openings through which mesh or stringing is threaded, or can be shaped (e.g., like a hook) to retain loops of the mesh or stringing.

As used herein, thread holes or thread openings refer to the openings that receive the various forms of pocket stringing, such as the holes in the scoop, sidewalls, and stop members, or the openings in tabs attached to the scoop, sidewalls, and stop members. The term "openings" should be construed broadly so as to encompass any hole or structure that retains the pocket stringing, including structures such as hooks. Also, as used herein, a pocket thread refers to any member, such as a thong, string, or mesh, that forms the pocket and/or attaches the pocket to the lacrosse head.

The traditional shape of a lacrosse head is commonly referred to as generally V-shaped. In other words, looking at the face of a lacrosse head, the width between the sidewalls increases as the sidewalls extend from the ball stop to the scoop, with the widest point being in the area of the transition between the sidewalls and the scoop. Typically, rules applicable to competitive lacrosse dictate the minimum width a lacrosse head must possess (e.g., 6½ inches). According to conventional thinking, providing the greatest width near the scoop enables a player to more easily scoop ground balls and catch thrown balls, and direct the balls down into the pocket of the lacrosse head.

With respect to scooping ground balls, improvements in the ball retention characteristics of lacrosse heads have changed the modem game of lacrosse such that it is now more difficult to check balls loose and create ground ball opportunities. Simply put, there are less ground balls in the modem game of lacrosse than were typical in years past. Consequently, the modem game emphasizes precise passing and catching over the scooping of ground balls.

In addition, with respect to catching thrown balls, it is now recognized that most players catch a ball in the center section of a lacrosse head, and not within the widest portion of the head near the scoop. Thus, players are more apt to miss a ball as it bounces off the closely positioned sidewalls in the center area of the head.

U.S. Pat. No. 5,685,791 to Feeney discloses a lacrosse head having a shape somewhat contrary to this conventional thinking. Feeney discloses a composite lacrosse head in a generally circular, or closed loop, configuration. Viewed from the front face, the central section of the Feeney head is of the greatest width. Starting from the ball stop, the sidewalls of the head immediately diverge away from each other in slightly convex lines to the point at which the central section reaches its greatest width. From that point to the scoop, the sidewalls converge toward each other in concave lines. FIG. 1B is a schematic diagram of the Feeney lacrosse head 196 showing the concave portions 197 and convex portions 198 of head 196, with dotted lines marking the approximate transitions between each section of the sidewalls.

As used herein, the terms concave and convex are discussed relative to the interior area defined by the ball stop, sidewalls, and scoop of a lacrosse head. In other words, looking at the front face of a lacrosse head, a convex sidewall bends toward the interior of the lacrosse head, while a concave sidewall bends away from the interior of the lacrosse head. The bending of a sidewall can be judged, for example, relative to a point drawn roughly in the center of the interior area of the lacrosse head.

Although the lacrosse head of Feeney may provide a larger catching area in the center area of the head, this increased area raises additional drawbacks. For example, the increased area enables a ball to rattle more within the head, making the control and retention of the ball difficult. In addition, the ordinary interwoven string pocket shown and described in Feeney compounds the difficulties in avoiding this ball rattle. In addition, because the sidewalls of Feeney diverge immediately starting from the ball stop, a ball can easily rattle and exit the head at locations very close to the ball stop.

Thus, in view of the drawbacks of conventionally shaped heads, there remains a need for a lacrosse head that provides a wide catching area, yet maximizes ball retention and control.

SUMMARY OF THE INVENTION

The present invention provides a lacrosse head that, in addition to providing a wide catching area, provides important aspects of ball retention and control.

An embodiment of the present invention provides an exemplary lacrosse head that includes a stop member, a left sidewall connected to the stop member, a right sidewall connected to the stop member, and a scoop connecting the left sidewall to the right sidewall opposite the stop member. The scoop is disposed about 25.5 cm from the stop member. The widest point of the lacrosse head is in a catching section disposed from about 6 cm to about 17 cm from the stop member. The left sidewall is convex at a portion of the left sidewall between the widest point and the scoop. The right sidewall is convex at a portion of the right sidewall between the widest point and the scoop. The convex sidewalls between the widest point and the scoop provide a narrower, funneled pocket through which a ball exits the head, thereby providing improved ball control and more accurate passing.

In a further aspect of the present invention, the width of the scoop is in a range from about 5 cm to about 15 cm measured perpendicularly to the shaft axis between the left sidewall and the right sidewall. This narrow width contrasts sharply with the wide scoops of traditional heads and with the widest point of the catching section. The narrow scoop funnels a ball out of the pocket during throwing to increase the accuracy of passes and to counteract any reduction in ball control that the wide catching area may cause.

In a further aspect of the present invention, the sidewalls rise from the plane of the scoop and include thong holes. In one embodiment, the scoop defines two inside thong holes, the left sidewall defines a left outside thong hole, and the right sidewall defines a right outside thong hole. This placement of the thong holes in conjunction with the rising sidewalls provides channeled thongs that help guide the ball in a straight line out of the pocket, and counteract any reduction in ball control that the wide catching area may cause.

In a further aspect of the present invention, the sidewalls are parallel to each other in the section of the lacrosse head between the stop member and the catching section. This parallel configuration further helps ball control and retention. In a further aspect of the present invention, the width of the scoop is less than the distance between the parallel sidewalls.

As discussed herein, measurements of the distance between sidewalls are taken from roughly the inside of the sidewalls, i.e., measuring the clear opening between the sidewalls. For example, such a measurement could be taken from the inside top rim of one sidewall to the inside top rim of the other sidewall. The measurements of the distance between sidewalls are also taken roughly perpendicularly to the shaft axis.

DETAILED DESCRIPTION OF THE INVENTION

Figure 2:
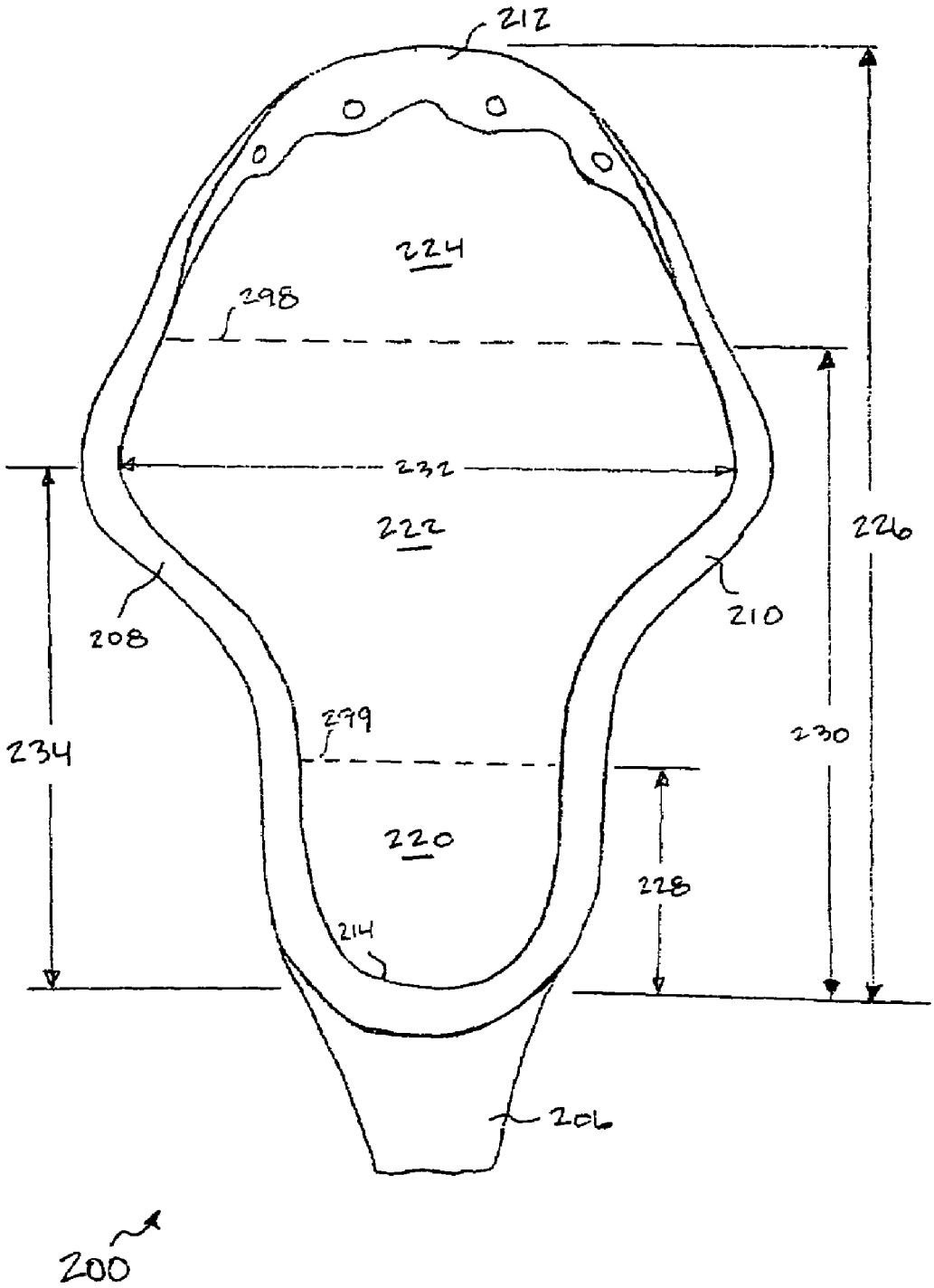
FIG. 2 is a schematic diagram of an exemplary lacrosse stick head, according to an embodiment of the present invention.

FIG. 2 illustrates an exemplary lacrosse head 200 according to an embodiment of the present invention. As shown, lacrosse head 200 includes a juncture 206, sidewalls 208 and 210, a scoop 212 joining the sidewalls at their ends opposite juncture 206, and a stop member 214 joining sidewalls 208 and 210 at their ends nearest juncture 206. A handle (not shown) fits into and through juncture 206, and abuts stop member 214.

As shown by the dotted lines 298 and 299 in FIG. 2, lacrosse head 200 is generally described herein with reference to three sections of the head: a rearward section 220, a catching section 222, and a forward section 224. As shown, rearward section 220 is nearest the ball stop 214 and forward section 224 is nearest the scoop 212. Catching section 222 is disposed in between rearward section 220 and forward section 224.

In a particular implementation of this embodiment of the present invention, the distance 226 from the middle of ball stop 214 to the end of scoop 212 is approximately 25.5 cm. The distance 228 from the middle of ball stop 214 to the line 299 between rearward section 220 and catching section 222 is approximately 6 cm. The distance 230 from the middle of ball stop 214 to the line 298 between catching section 222 and forward section 224 is approximately 17 cm.

As one of ordinary skill in the art would appreciate, the dimensions of rearward section 220, catching section 222, and forward section 224 could vary as desired for a particular application, such as for a men's or women's lacrosse stick head, for junior lacrosse stick heads, for offensive or defensive lacrosse stick heads, or for recreational or trick lacrosse stick heads. In general, for men's or women's competitive lacrosse stick heads, the distance 226 could range from about 25 cm to about 31 cm, the distance 230 could range from about 16 cm to about 23 cm, and the distance 228 could range from about 3 cm to about 7 cm.

As shown in FIG. 2, the widest distance 232 between sidewalls 208 and 210 is within catching section 222. In a particular implementation, this distance 232 is approximately 16.5 cm. In general, for men's and women's competitive lacrosse stick heads, the distance 232 could range from about 16 cm to about 26 cm.

An important aspect of the present invention is the manner by which sidewalls 208 and 210 transition between ball stop 214, the widest point 232 of catching section 222, and scoop 212. Preferably, within rearward section 220, sidewalls 208 and 210 remain substantially parallel. From line 299 (between rearward section 220 and catching section 222) to near the widest point 232 of catching section 222, sidewalls 208 and 210 preferably diverge (i.e., the distance between them increases) along convex lines. From near the widest point 232 of catching section 222 to near scoop 212, sidewalls 208 and 210 preferably converge along convex lines. The net result of this sidewall configuration is that lacrosse head 200 is pinched above and below the widest point 232 of catching section 222.

Figure 1A:
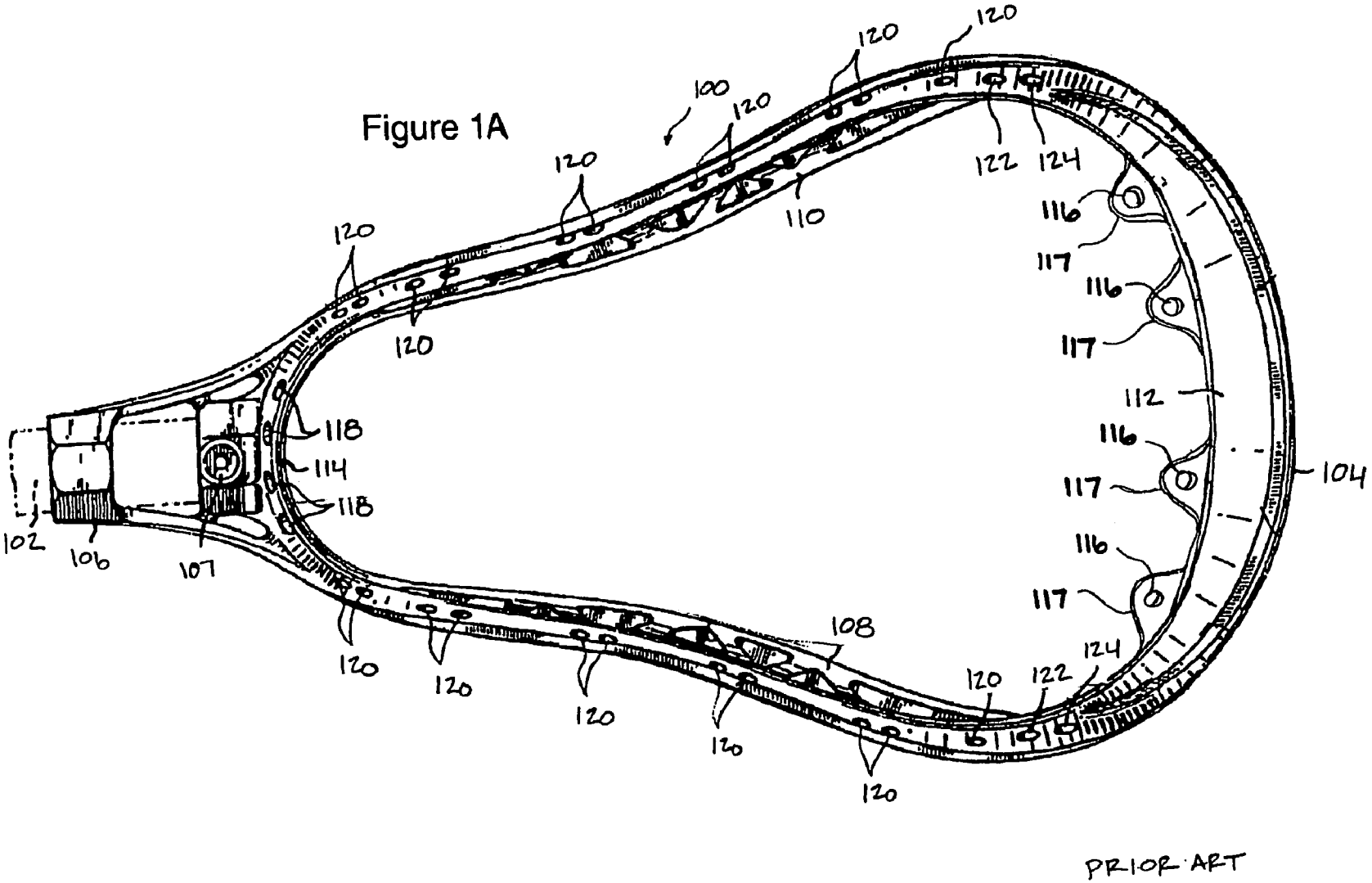
FIG. 1A is a schematic diagram of a conventional lacrosse stick.
Figure 1B:
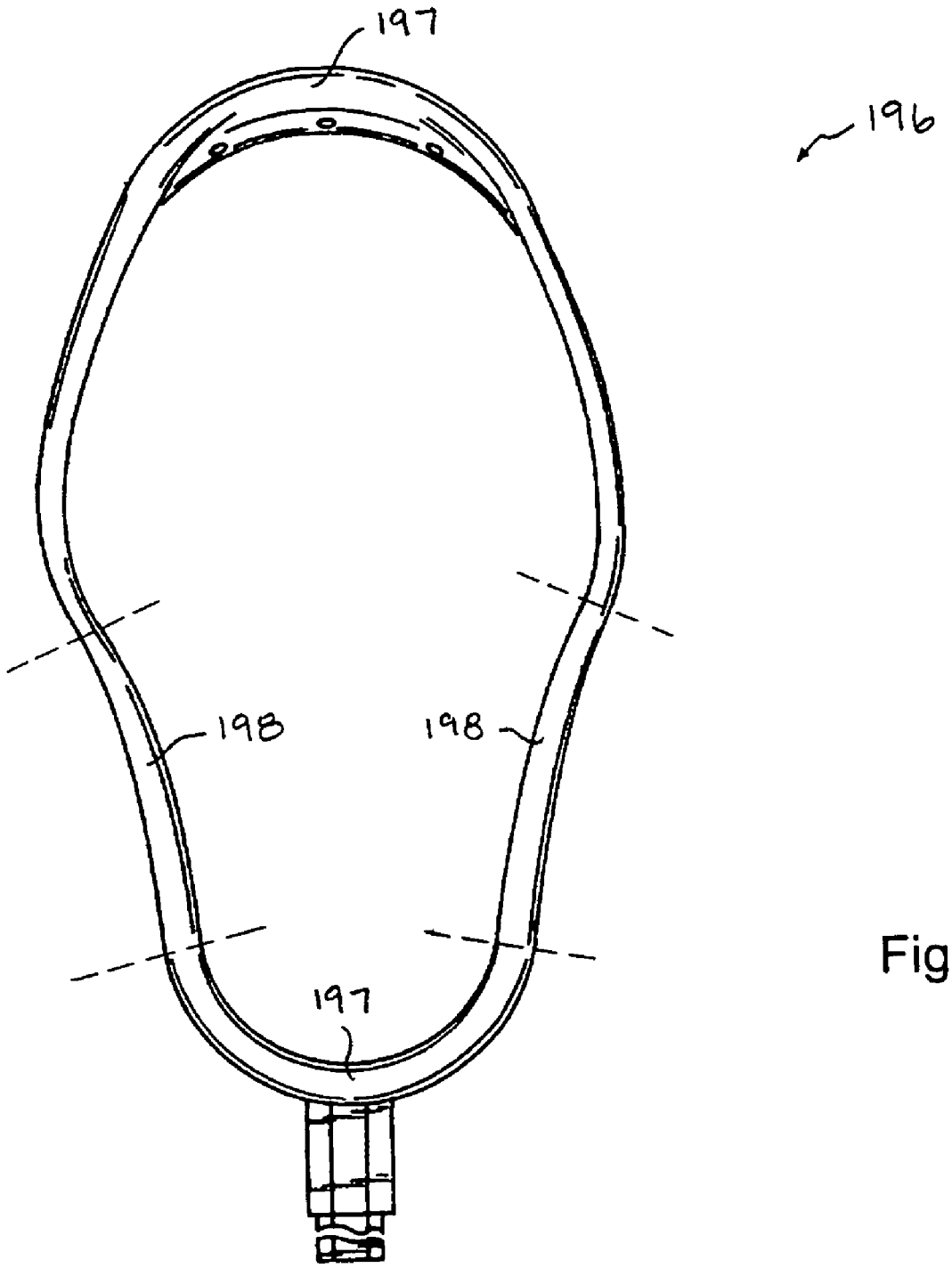
FIG. 1B is a schematic diagram of a prior art lacrosse head (from U.S. Pat. No. 5,685,791 to Feeney) showing the convex portions and concave portions of the head.
Figure 3:
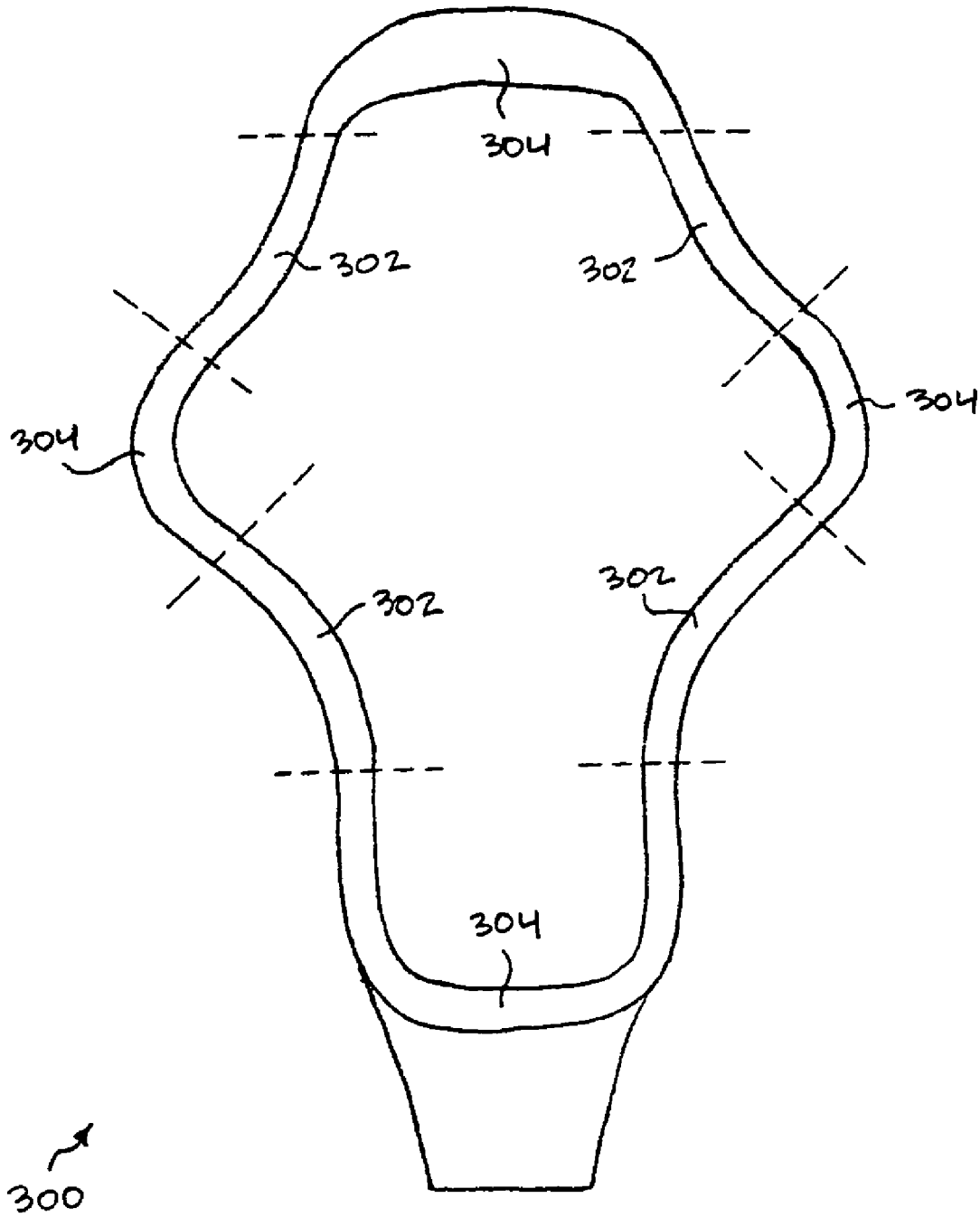
FIG. 3 is a schematic diagram illustrating the concave and convex portions of an exemplary head according to an embodiment of the present invention.

FIG. 3 is a schematic diagram illustrating the concave and convex portions of an exemplary head 300 of the present invention. As shown, head 300 includes convex portions 302 and concave portions 304. The dotted lines of FIG. 3 represent the approximate transitions between each convex or concave portion of head 300. As shown in FIG. 3, in an aspect of the present invention, the pinching (i.e., convex portions 302) above the widest point 232 (FIG. 2) is especially advantageous over conventional lacrosse heads that place their widest point in the catching section but converge the sidewalls along concave lines between the widest point and the scoop, such as the lacrosse head shown in Feeney (see FIG. 1B).

With continuing reference to FIGS. 2 and 3, providing pinched sidewalls 208 and 210 above and below the widest point 232 decreases ball rattle, increases a player's ability to retain a ball in the pocket, and provides a straight channel through which a ball can rise from ball stop and leave the pocket for a more accurate throw. Thus, a player is able to easily catch a ball through the widest point 232, and then hold and cradle the ball within the narrow rearward section 220. The proximity of sidewalls 208 and 210 in the rearward section 220 reduces the distance in which a ball can rattle. Then, upon throwing the ball, the narrow distance between sidewalls 208 and 210 in the rearward section 220 and forward section 224 keeps the ball centered in the pocket as it travels up the pocket and off of either throwing strings or scoop 212.

A further aspect of the present invention provides a dramatic convex transition of sidewalls 208 and 210 between near the widest point 232 of catching section 222 and the line 299 between catching section 222 and rearward section 220. This significant decrease in width between sidewalls 208 and 210 creates a markedly pinched configuration and quickly brings sidewalls 208 and 210 to the minimal distance apart that is held in rearward section 220, where sidewalls 208 and 210 are substantially parallel.

In one exemplary head, referring to FIG. 2, the distance 234 between the widest point 232 of catching section 222 and the ball stop 214 is about 15 cm, the distance 228 is about 3.5 cm, the widest point 232 is about 16.5 cm, and the distance between sidewalls 208 and 210 at line 299 is about 7 cm (which is the distance at which sidewalls 208 and 210 remain substantially parallel in rearward section 220). Therefore, according to this example, the distance between sidewalls 208 and 210 at line 299 would be approximately 43% of the widest point 232, with the change in width occurring over 11.5 cm, which is equal to distance 234 minus distance 228. In general, according to embodiments of the present invention, distance 228 would range from about 3 cm to about 7 cm, distance 234 would range from about 13 cm to about 18 cm, and the proportion of the width at line 299 to the width at widest point 232 would be from about 40% to about 60%. This significant transition enables a lacrosse head according to the present invention to provide a wide catching area, while at the same time providing a narrow rearward section 220 with closely spaced parallel sidewalls that enhance ball retention and control.

Figure 4:
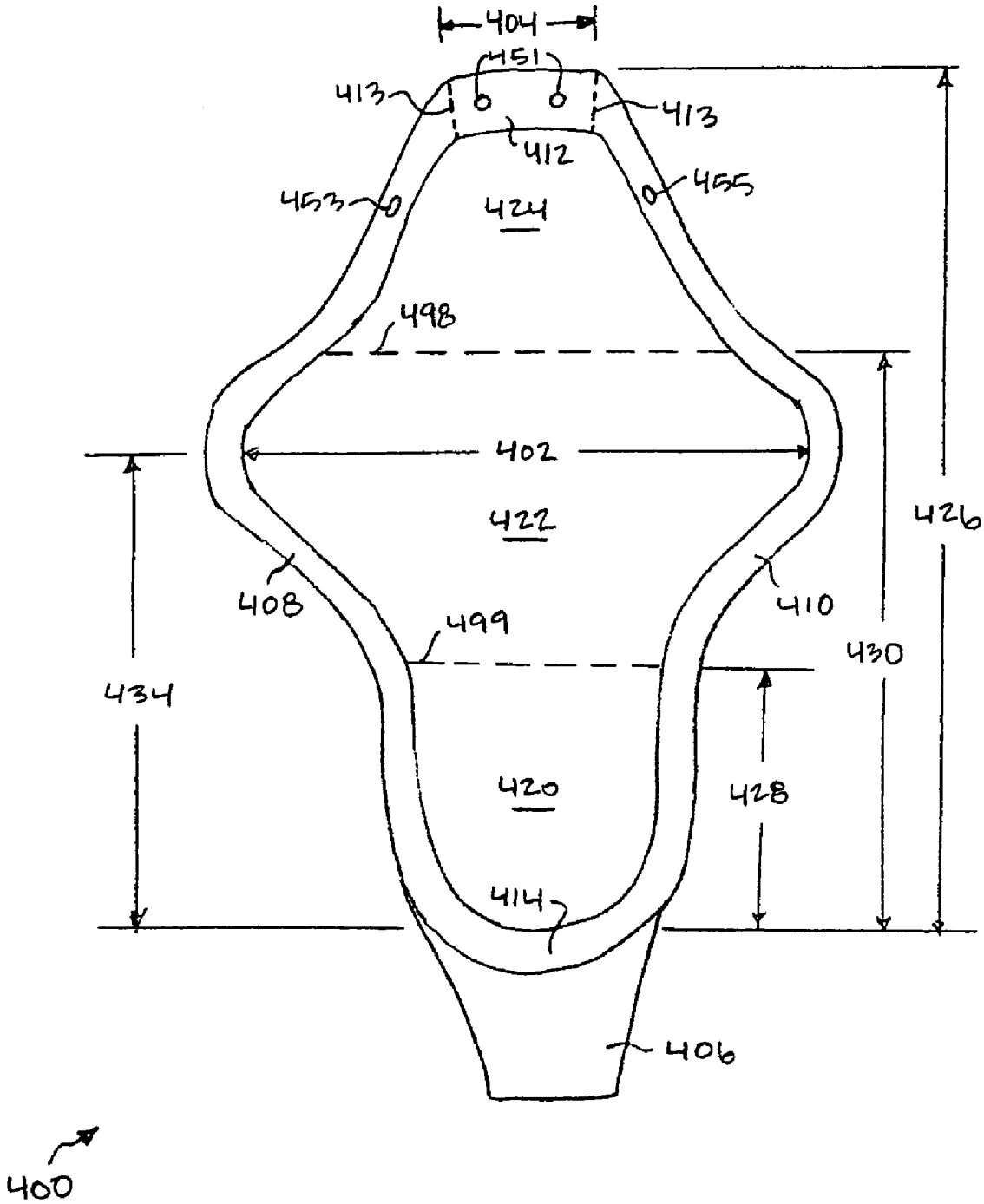
FIG. 4 is a schematic diagram of an exemplary lacrosse head having its widest point in the catching section, having a small scoop width, and having a forward section that changes planes between the sidewalls and the scoop, according to an embodiment of the present invention.
Figure 5:
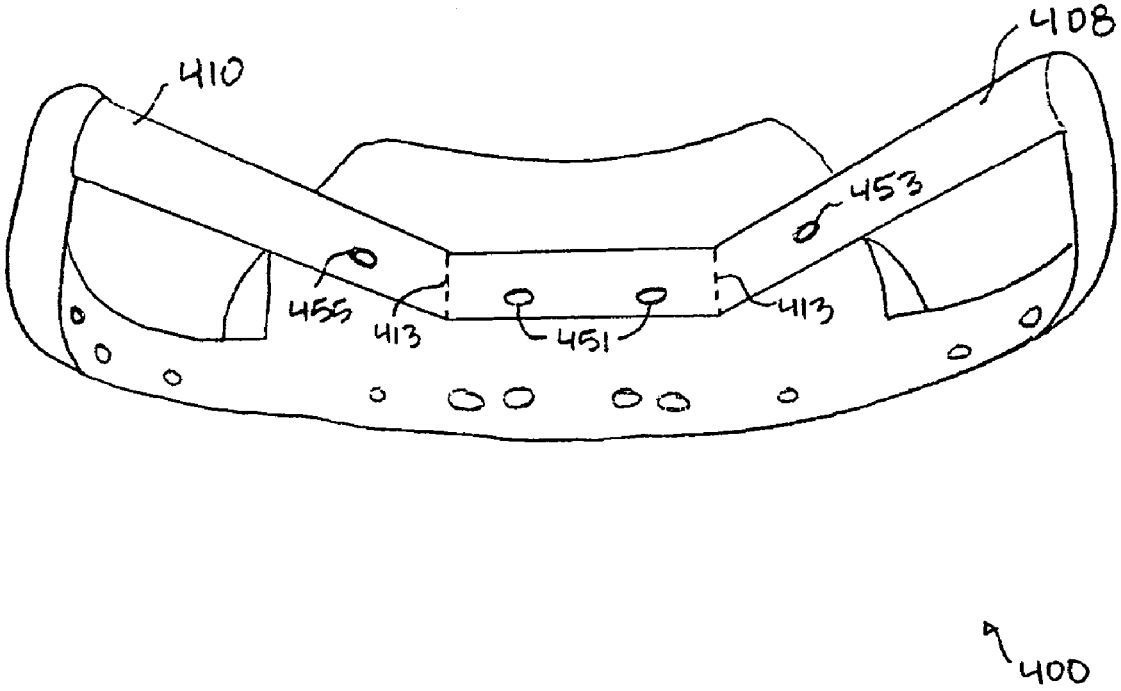
FIG. 5 is a schematic diagram of a top view of the exemplary lacrosse head of FIG. 4 looking down at the scoop of the head, according to an embodiment of the present invention.

In a further embodiment of the present invention, FIGS. 4 and 5 illustrate an exemplary lacrosse head 400 having its widest point 402 in the catching section 422, having a small scoop width 404, and having a forward section 424 that changes planes between the sidewalls 408 and 410 and the scoop 412. Having the widest point 402 in the catching section 422 provides the performance benefits discussed above. Having a small scoop width 404 provides a channel through which the ball can rise on the pocket and exit the lacrosse head 400. This channel facilitates more accurate passing, which is the primary focus of the modern game of lacrosse. Having a forward section 424 that changes planes between the sidewalls 408 and 410 and the scoop 412 enables the placement of thongs at different planes to further create a channel.

As shown in FIG. 4, lacrosse head 400 includes a juncture 406, sidewalls 408 and 410, a scoop 412 joining the sidewalls at their ends opposite juncture 406, and a stop member 414 joining sidewalls 408 and 410 at their ends nearest juncture 406. A handle (not shown) fits into and through juncture 406, and abuts stop member 414. As shown by the dotted lines 498 and 499 in FIG. 4, lacrosse head 400 includes a rearward section 420, a catching section 422, and a forward section 424.

In one implementation, at the line 499 between rearward section 420 and catching section 422, the distance between sidewalls 408 and 410 is about 7 cm and line 499 is a distance 428 of about 7 cm from ball stop 414. The widest point 402 of catching section 422 is about 16.5 cm and is located at a distance 434 of about 15 cm from ball stop 414. At the line 498, which is located at a distance 430 of about 17 cm from ball stop 414, the distance between sidewalls 408 and 410 is about 14 cm. The distance 426 from ball stop 414 to the end of scoop 412 is approximately 25.5 cm. Finally, the width 404 of scoop 412 is about 8 cm.

Figure 6:
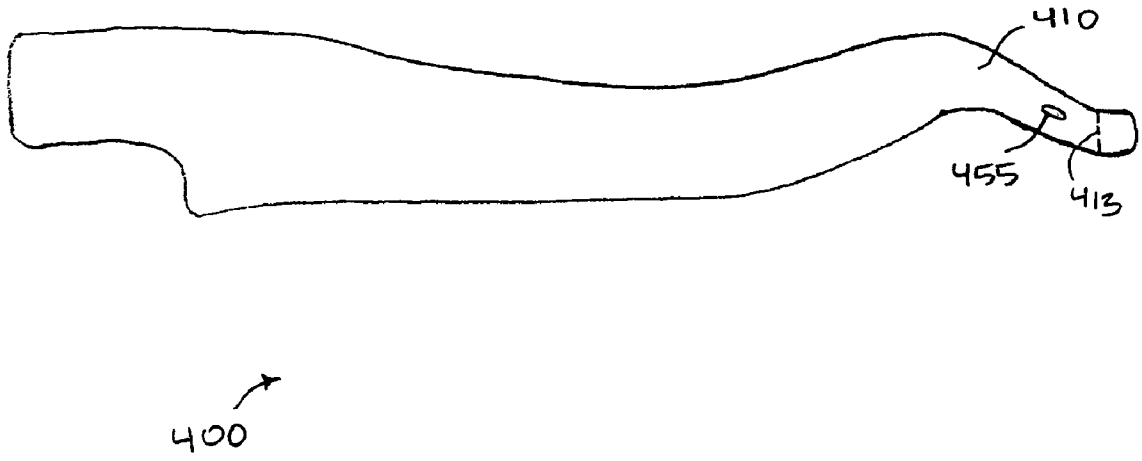
FIG. 6 is a schematic diagram of a side view of the exemplary lacrosse head of FIG. 4 looking at a sidewall of the head, according to an embodiment of the present invention.

As represented by the dotted lines 413 in FIG. 4, sidewalls 408 and 410 rise from the plane of scoop 412. The side elevation views of FIGS. 5 and 6 show this rise more clearly. In an embodiment of the present invention, two inner thong holes 451 are disposed in scoop 412, one outer thong hole 453 is disposed in sidewall 408, and another outer thong hole 455 is disposed in sidewall 410. Thong holes 453 and 455 are disposed in a higher plane than thong holes 451 because of the rising sidewalls 408 and 410.

As used herein to describe the higher and lower relative positions of the scoop, the sidewalls, and thongs attached to the scoop and sidewalls, a plane is parallel to the face of a lacrosse head, which is defined generally by the top edges of the stop member and sidewalls. One plane, for example, is defined by the shaft axis and a line that is drawn perpendicularly to the shaft axis and intersects equivalent points of the sidewalls (i.e., the line intersects a point on the first sidewall and a point on the second sidewall that are both a substantially equal distance below the top edge of their respective sidewalls).

Referring to FIGS. 4-6, in an alternative embodiment of the present invention, the width 404 of scoop 412 is less than the distance between sidewalls 408 and 410 in the rearward section 420, where sidewalls 408 and 410 are parallel. This narrow scoop 412, in conjunction with the thong holes 453 and 455 being disposed on a plane higher than thong holes 451, positions the thongs in a channel configuration. In this manner, thong holes 451 contact a lower portion of the lacrosse ball, while thong holes 453 and 455 contact a higher, side portion of the lacrosse ball. In an embodiment of the present invention, the distance between thong holes 451 is about 1¼ inches (equal to half of the diameter of a typical lacrosse ball) so that the thongs contact a bottom portion of the ball. This distance, which is smaller than those found on conventional lacrosse heads, coincides with the narrower scoop and provides the desired channel.

Figure 7:
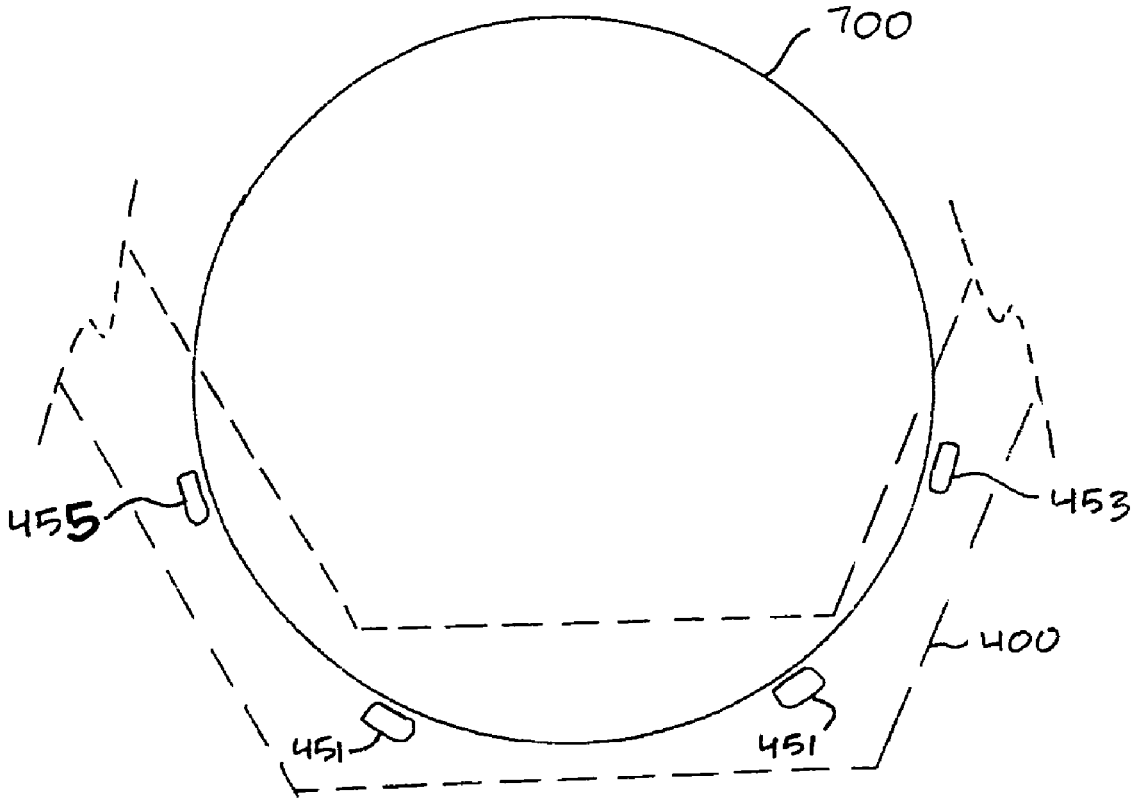
FIG. 7 is a schematic diagram that illustrates the positions of thongs on an exemplary lacrosse head, according to an embodiment of the present invention

FIG. 7 illustrates exemplary positions of the thongs created by the narrow scoop 412 and the thong holes 453 and 455 being disposed on a plane higher than thong holes 451, according to an embodiment of the present invention. As shown, thongs strung to thong holes 451 contact the lower portion of a lacrosse ball 700. Thongs strung to thong holes 453 and 455, which are disposed on the rising sidewalls 408 and 410, are positioned in a plane higher than that of the thongs strung to thong holes 451 and contact a higher portion (e.g., the sides) of ball 700. The thong holes 451, 453, and 455 therefore position the thongs in a channel configuration that holds guide ball 700 in the center of the pocket as it rises in the pocket during a throw.

Overall, embodiments of the present invention provide many benefits over conventional lacrosse heads. Placing the widest point of the head in the catching section, and not in the forward section, makes it easier for players to catch lacrosse balls. Narrowing the scoop and changing the plane of the sidewalls with respect to the scoop guides the ball so that the ball leaves the pocket in a more funneled manner, thereby improving playability. Further, the reshaped and resized scoop, along with the novel placement of thong holes on the sidewalls, places the thongs, or leathers, in different planes than do conventional heads. The two outside thongs that are disposed on the sidewalls are raised relative to the two inside leathers, which creates a channel effect. Thus, although during a throw the ball has more space in which to rattle in the catching section where the head is wider, the channel prevents this rattling and controls the exiting of the ball. As a result, a lacrosse head of the present invention provides a wider catching area where the ball is intended to be caught, but overcomes the potentially negative consequence of ball rattle via the stringing channel.

The wider catching section provides other benefits as well. For example, the wider area of the catching section allows the stringing to sag more in the pocket across this wider area during cradling, in comparison to conventional heads. This sagging effect increases the centrifugal force while the ball is being cradled, which stabilizes the ball in the pocket. During the throwing motion, however, less centrifugal force is exerted on the pocket, which lessens sag, thereby maintaining the accuracy of the throw.

The wider catching section and narrower forward section also provide a more favorable center of gravity in comparison to conventional lacrosse heads. The wider catching section shifts more weight of the head toward the player's hand positioned just below the throat of the head. This shift in weight places the center of the gravity of the head closer to the player's hand, giving the player a better feel for the position of the head and providing a greater sense of control. In addition, shifting mass from the forward section to the catching section decreases the radius from center of gravity to the axis of rotation, thereby decreasing the torque on the head and increasing the player's control and feel of the ball in the pocket.

As another benefit, the present invention pinches the scoop area creating a narrow channel for throwing accuracy. Repeatedly, the ball is released from the center most point on the stick as opposed to a conventional head where there is limited control over the angle the ball is released off the wide scoop. The track that is formed by the forward pinched characteristic of the head of the present invention forces the ball to be released from the center of the scoop, which is the highest point on the head.

In addition, the invention allows for a greater moment of inertia. The moment of inertia is the sum of all the masses multiplied by the radius squared. When the mass (i.e., the ball) is concentrated farther away from the axis of rotation or higher on the head, the moment of inertia will be greater, thus giving strength to the shot. The greater the moment of inertia, the more difficult it is for an external force to change the position of the head, therefore, providing accuracy to a throw or shot from the head.

According to an aspect of the present invention, a lacrosse head having a wide catching section, such as head 200 shown in FIG. 2, is an injection-molded, monolithic structure made of a durable synthetic material. Examples of materials suitable for the lacrosse head include nylon, urethane, polycarbonate, polyethylene, polypropylene, polyketone, polybutylene terephalate, acetals (e.g., Delrin™ by DuPont), acrylonitrile-butadiene-styrene (ABS), acrylic, and acrylic-styrene-acrylonitrile (ASA). In one embodiment, the lacrosse head of the present invention is constructed of DuPont™ ZYTEL ST 801 nylon resin.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse head comprising:

a stop member;

a left sidewall connected to the stop member;

a right sidewall connected to the stop member; and a scoop connecting the left sidewall to the right sidewall opposite the stop member, the lacrosse head having a shaft axis along which the lacrosse head is adapted to receive a shaft, the stop member, the left sidewall, the right sidewall, and the scoop defining an interior area of the lacrosse head, the interior area comprising a rearward section disposed proximate the stop member, a forward section disposed proximate the scoop, and a catching section disposed in between the rearward section and the forward section, the scoop being disposed about 25.5 cm from the stop member, the catching section being disposed from about 6 cm to about 17 cm from the stop member, the left sidewall being a greatest distance apart from the right sidewall at a widest point within the catching section, the greatest distance being measured perpendicularly to the shaft axis, the left sidewall being convex with respect to the interior area at a portion of the left sidewall between the widest point and the scoop, and the right sidewall being convex with respect to the interior area at a portion of the right sidewall between the widest point and the scoop, wherein the distance between the left sidewall and the right sidewall, measured perpendicularly to the shaft axis, continually decreases in a direction from the widest point to the scoop.

2. The lacrosse head of claim 1, the left sidewall being substantially parallel to the right sidewall within the rearward section.

3. The lacrosse head of claim 2, the widest point being disposed within a range of about 13 cm to about 18 cm from the stop member, the left sidewall being a parallel distance apart from the right sidewall within the rearward section, the parallel distance being measured perpendicularly to the shaft axis, and the parallel distance being within a range of approximately 40% to approximately 60% of the greatest distance.

4. The lacrosse head of claim 2, the left sidewall being a parallel distance apart from the right sidewall within the rearward section, the parallel distance being measured perpendicularly to the shaft axis, the scoop having a width measured perpendicularly to the shaft axis between the left sidewall and the right sidewall, and the width being less than the parallel distance.

5. The lacrosse head of claim 1, the scoop having a width in a range from about 5 cm to about 15 cm measured perpendicularly to the shaft axis between the left sidewall and the right sidewall.

6. The lacrosse head of claim 5, the left sidewall and the right sidewall rising from a plane of the scoop, the plane being substantially parallel to a face of the lacrosse head defined by the left sidewall and the right sidewall.

7. The lacrosse head of claim 6, the scoop defining a first thong hole and a second thong hole, the left sidewall defining a left thong hole, and the right sidewall defining a right thong hole.

8. The lacrosse head of claim 7, further comprising a first thong strung from the stop member to the left thong hole, a second thong strung from the stop member to the first thong hole of the scoop, a third thong strung from the stop member to the second thong hole of the scoop, and a fourth thong strung from the stop member to the right thong hole.

9. The lacrosse head of claim 8, the second thong and the third thong being on a lower plane in the forward section than the first thong and the fourth thong.

10. The lacrosse head of claim 1, further comprising a shaft attached to the lacrosse head proximate the stop member, the shaft axis of the lacrosse head coinciding with the shaft's axis.

11. A lacrosse head comprising:

a stop member;

a left sidewall connected to the stop member;

a right sidewall connected to the stop member; and a scoop connecting the left sidewall to the right sidewall opposite the stop member, the lacrosse head having a shaft axis along which the lacrosse head is adapted to receive a shaft, the stop member, the left sidewall, the right sidewall, and the scoop defining an interior area of the lacrosse head, the left sidewall being a greatest distance apart from the right sidewall at a widest point the greatest distance being measured perpendicularly to the shaft axis, and the widest point being disposed within a range from about 6 cm to about 17 cm from the stop member, the left sidewall being convex with respect to the interior area over at least a portion of the left sidewall between the widest point and the scoop, and the right sidewall being convex with respect to the interior area at a portion of the right sidewall between the widest point and the scoop, wherein the distance between the left sidewall and the right sidewall, measured perpendicularly to the shaft axis, continually decreases in a direction from the widest point to the scoop.

12. The lacrosse head of claim 11, the left sidewall being convex with respect to the interior area over at least a portion of the left sidewall between the stop member and the widest point, and the right sidewall being convex with respect to the interior area over at least a portion of the right sidewall between the stop member and the widest point.

13. The lacrosse head of claim 11, the left sidewall being substantially parallel to the right sidewall from the stop member to approximately 6 cm from the stop member.

14. The lacrosse head of claim 13, the left sidewall being substantially parallel to the right sidewall at a parallel distance, the scoop having a width between the left sidewall and the right sidewall, and the width being less than the parallel distance.

15. The lacrosse head of claim 11, the shaft axis and a line defining a first plane, the line drawn perpendicular to the shaft axis and intersecting equivalent points on the left sidewall and the right sidewall, the scoop being disposed in a second plane that is parallel to the first plane, and the first sidewall and the second sidewall rising from the second plane.

16. The lacrosse head of claim 15, the scoop having a width less than the widest point and in a range from about 5 cm to about 15 cm measured perpendicularly to the shaft axis between the left sidewall and the right sidewall.

17. The lacrosse head of claim 16, the scoop defining a first thong hole and a second thong hole, the left sidewall defining a left thong hole, and the right sidewall defining a right thong hole.

18. The lacrosse head of claim 17, the first thong hole and the second thong hole disposed in the second plane, and the left thong hole and the right thong hole disposed in a third plane parallel to the second plane, the third plane being different from the second plane.

19. The lacrosse head of claim 18, further comprising a first thong strung from the stop member to the left thong hole, a second thong strung from the stop member to the first thong hole of the scoop, a third thong strung from the stop member to the second thong hole of the scoop, and a fourth thong strung from the stop member to the right thong hole.

20. The lacrosse head of claim 11, further comprising a shaft attached to the lacrosse head proximate the stop member, the shaft axis of the lacrosse head coinciding with the shaft's axis.

21. The lacrosse head of claim 11, the lacrosse head being formed of injection molded synthetic material.

22. A lacrosse head comprising:

a stop member;

a left sidewall connected to the stop member;

a right sidewall connected to the stop member; and a scoop connecting the left sidewall to the right sidewall opposite the stop member, the lacrosse head having a shaft axis along which the lacrosse head is adapted to receive a shaft, the left sidewall being a greatest distance apart from the right sidewall at a widest point the greatest distance being measured perpendicularly to the shaft axis when the lacrosse head is viewed from a plan view, and the widest point being disposed within a range from about 6 cm to about 17 cm from the stop member, the left sidewall defining a first concave corner at the widest point when the lacrosse head is viewed from the plan view, and the second sidewall defining a second concave corner at the widest point when the lacrosse head is viewed from the plan view, the shaft axis and a line defining a first plane, the line drawn perpendicular to the shaft axis and intersecting equivalent points on the left sidewall and the right sidewall, the scoop being substantially planar and disposed in a second plane that is parallel to the first plane, and the first sidewall and the second sidewall rising from the second plane, the scoop and the first sidewall meeting at a third concave corner when the lacrosse head is viewed from the plan view, the third concave corner spaced apart from the first concave corner, and the first sidewall rising in a direction from the third concave corner toward the widest point, the scoop and the second sidewall meeting at a fourth concave corner when the lacrosse head is viewed from the plan view, the fourth concave corner spaced apart from the second concave corner, and the second sidewall rising in a direction from the third concave corner to the widest point, and the first sidewall and the second sidewall diverging from each other in a direction from the scoop toward the widest point.

23. The lacrosse head of claim 22, further comprising a shaft attached to the lacrosse head proximate the stop member, the shaft axis of the lacrosse head coinciding with the shaft's axis.

24. The lacrosse head of claim 22, the scoop having a width less than the widest point and in a range from about 5 cm to about 15 cm measured perpendicularly to the shaft axis between the left sidewall and the right sidewall from the first outside corner to the second outside corner, when the lacrosse head is viewed from the plan view.

25. The lacrosse head of claim 24, the scoop defining a first thong hole and a second thong hole, the left sidewall defining a left thong hole between the first concave corner and the third concave corner, and the right sidewall defining a right thong hole between the second concave corner and the fourth concave corner.

26. The lacrosse head of claim 25, the first thong hole and the second thong hole disposed in the second plane, and the left thong hole and the right thong hole disposed in a third plane parallel to the second plane and the first plane, the third plane being different from the second plane.

27. The lacrosse head of claim 25, the left sidewall being disposed at a substantially constant distance from the right sidewall in a section of the lacrosse head from the stop member to approximately 6 cm from the stop member, and the width of the scoop as measured from the third concave corner to the fourth concave corner being less than the substantially constant distance.

* * * * *